US012440884B2

(12) United States Patent
Sung et al.

(10) Patent No.: US 12,440,884 B2
(45) Date of Patent: Oct. 14, 2025

(54) AUTOMATIC CONTROL SYSTEM FOR BACKWARD FLOW FORMING PROCESS

(71) Applicant: IL KWANG TECH CO. LTD., Cheongju-si (KR)

(72) Inventors: Nak Young Sung, Cheongju-si (KR); Seong Su Im, Cheongju-si (KR)

(73) Assignee: IL KWANG TECH CO. LTD., Cheongju-si (KR)

( * ) Notice: Subject to any disclaimer, the term of this patent is extended or adjusted under 35 U.S.C. 154(b) by 267 days.

(21) Appl. No.: 18/314,254

(22) Filed: May 9, 2023

(65) Prior Publication Data

US 2023/0381847 A1 Nov. 30, 2023

(30) Foreign Application Priority Data

May 27, 2022 (KR) ..... 10-2022-0065115

(51) Int. Cl.
*B21D 22/16* (2006.01)

(52) U.S. Cl.
CPC ..... *B21D 22/16* (2013.01)

(58) Field of Classification Search
CPC ..... B21D 22/14; B21D 22/16; B21D 22/18; B21C 37/16; B21C 51/00; B21H 1/12
See application file for complete search history.

(56) References Cited

U.S. PATENT DOCUMENTS

| | | | | |
|---|---|---|---|---|
| 4,669,291 | A * | 6/1987 | Asari | B21D 22/16 72/85 |
| 4,823,580 | A * | 4/1989 | Kadotani | B21H 1/12 72/110 |
| 5,711,174 | A * | 1/1998 | Dohi | B21H 1/06 72/85 |
| 2004/0034980 | A1 | 2/2004 | Pollkoetter | |
| 2022/0062967 | A1 * | 3/2022 | López | B21D 22/16 |

FOREIGN PATENT DOCUMENTS

| | | | |
|---|---|---|---|
| JP | 2010029893 | A | 2/2010 |
| KR | 10-0375702 | B1 | 3/2003 |
| KR | 2009-0105591 | A | 10/2009 |

* cited by examiner

*Primary Examiner* — Teresa M Ekiert
(74) *Attorney, Agent, or Firm* — NKL LAW; Jae Youn Kim

(57) ABSTRACT

The present invention relates to an automatic control system for a backward flow forming process, the automatic control system including: a mandrel (10) for concentrically supporting a material (12); a forming member (20) including a plurality of forming rollers (22) disposed at a periphery of the mandrel (10), in which each of the forming rollers (22) includes a motion device; a detection member (30) for detecting a signal associated with a motion of the forming member (20) corresponding to the material (12); and a controller (40) for controlling the forming roller (22) to induce a variation in a depth at at least two set points while transferring the forming roller (22) backward. Accordingly, a length deviation caused by a variation in a thickness is prevented in a backward flow forming process of a workpiece to produce a product in which a thickness of a portion of the product varies.

2 Claims, 4 Drawing Sheets

AUTOMATIC CONTROL SYSTEM FOR BACKWARD FLOW FORMING PROCESS

BACKGROUND OF THE INVENTION

1. Field of the Invention

The present invention relates to monitoring of a flow forming process, and more particularly, to an automatic control system for a backward flow forming process, capable of inducing a decrease in a thickness of a material and an increase in a length of the material while pressing the material with a plurality of rollers and moving the rollers in a state where the material rotates.

2. Description of the Related Art

Typically, flow forming may be configured based on a mandrel and a plurality of rollers that move in a radial direction of the mandrel, in which while pressing a rotating material with each of the rollers and moving the rollers, a thickness of the material may be decreased, and a length of the material may be increased, so that a product (intermediate product) may be formed. Automation control of a mass production process may be performed by processes of creating dimensions of all components including the rollers and the mandrel, dimensions of the material before the forming and the product after the forming, and the like by a general-purpose CAD, and converting a creation result by a flow forming computer numerical control (CNC) program to execute the creation result.

Nonetheless, even for universally applied backward flow forming, process parameters may be complicated so that production delays or forming defects may be caused easily.

As documents of the related art, Korean Unexamined Patent Publication No. 2009-0105591 (Related Document 1), Korean Patent Registration No. 0375702 (Related Document 2), and the like may be referred to in relation to countermeasures against the above problems.

Related Document 1 discloses a forming method including a first step of mounting a preform on a mandrel to rotate the a preform, and a second step of flow-forming the preform in a seamless tube shape by pressing a forming roll on an outer circumferential surface of the preform to allow the forming roll to make close contact with the preform, wherein the second step further includes an intermediate step of adjusting a vertical distance between central axes of the forming roll and the mandrel, and the method is controlled by a control unit operated by a computer numerical control (CNC) operation scheme.

Related Document 2 discloses a method including a flow forming step of simultaneously and continuously reducing a thickness of a preform on an entire circumferential surface of the preform by pressing a rolling roller against the preform from a radial direction toward an axial direction of the mandrel, and allowing the rolling roller to advance with respect to the mandrel in a longitudinal direction at a set speed. Accordingly, a manufacturing mechanism may be simplified, scraps may be reduced, and productivity and a yield may be increased.

However, according to the related documents described above, it may be insufficient to prepare for a case of applying backward forming to a workpiece so as to allow a variation in a thickness of a product, so that there is still room for improvement.

DOCUMENTS OF RELATED ART

Patent Documents (Patent Document 1) Korean Unexamined Patent Publication No. 2009-0105591 "Pressure Container Liner with Modified Thickness and Method for Forming the Same" (published on Oct. 7, 2009)

(Patent Document 2) Korean Patent Registration No. 0375702 "Method for Manufacturing Seamless Tube for Manufacturing Alloy Wheel of Vehicle" (published on Jul. 12, 2001)

SUMMARY OF THE INVENTION

To solve the conventional problems described above, an object of the present invention is to provide an automatic control system for a backward flow forming process, capable of preventing a length deviation caused by a variation in a thickness in the backward flow forming process for producing a product in which a thickness of a portion of the product varies while a material rotates.

To achieve the object described above, according to the present invention, there is provided an automatic control system for a backward flow forming process, the automatic control system including: a mandrel for concentrically supporting a material; a forming member including a plurality of forming rollers disposed at a periphery of the mandrel, in which each of the forming rollers includes a motion device; a detection member for detecting a signal associated with a motion of the forming member corresponding to the material; and a controller for controlling the forming roller to induce a variation in a depth at at least two set points while transferring the forming roller backward.

According to the detailed configuration of the present invention, the forming member may induce individual transfer and depth motions with motion devices connected to each of three forming rollers.

According to the detailed configuration of the present invention, the detection member may include a proximal detector installed on one side of the material in an elongation direction of the material, a distal detector installed on an opposite side of a transfer path of the forming roller, and a depth detector for detecting a radial depth displacement of the forming roller.

According to the detailed configuration of the present invention, the detection member may further include a load detector for detecting a load acting on the material through the forming roller.

According to the detailed configuration of the present invention, the controller may interwork with a computer numerical control (CNC) program to sequentially execute a biaxial motion of the forming roller, and stop processing according to a dimension required for a concave part of the material.

As described above, according to the present invention, a length deviation caused by a variation in a thickness can be prevented in a backward flow forming process of a workpiece to produce a product in which a thickness of a portion of the product varies, so that defects can be reduced, and advantages can be obtained especially for small-quantity batch production.

DETAILED DESCRIPTION OF THE INVENTION

Hereinafter, an embodiment of the present invention will be described in detail with reference to the accompanying drawings.

The present invention proposes a system for automatically controlling a backward flow forming process. The present invention relates to a flow forming system in which a material (workpiece) having a tube or cup shape is input so as to gradually form the material, but is not necessarily limited thereto.

According to the present invention, a mandrel 10 may have a structure for concentrically supporting a material 12.

Figure 1:
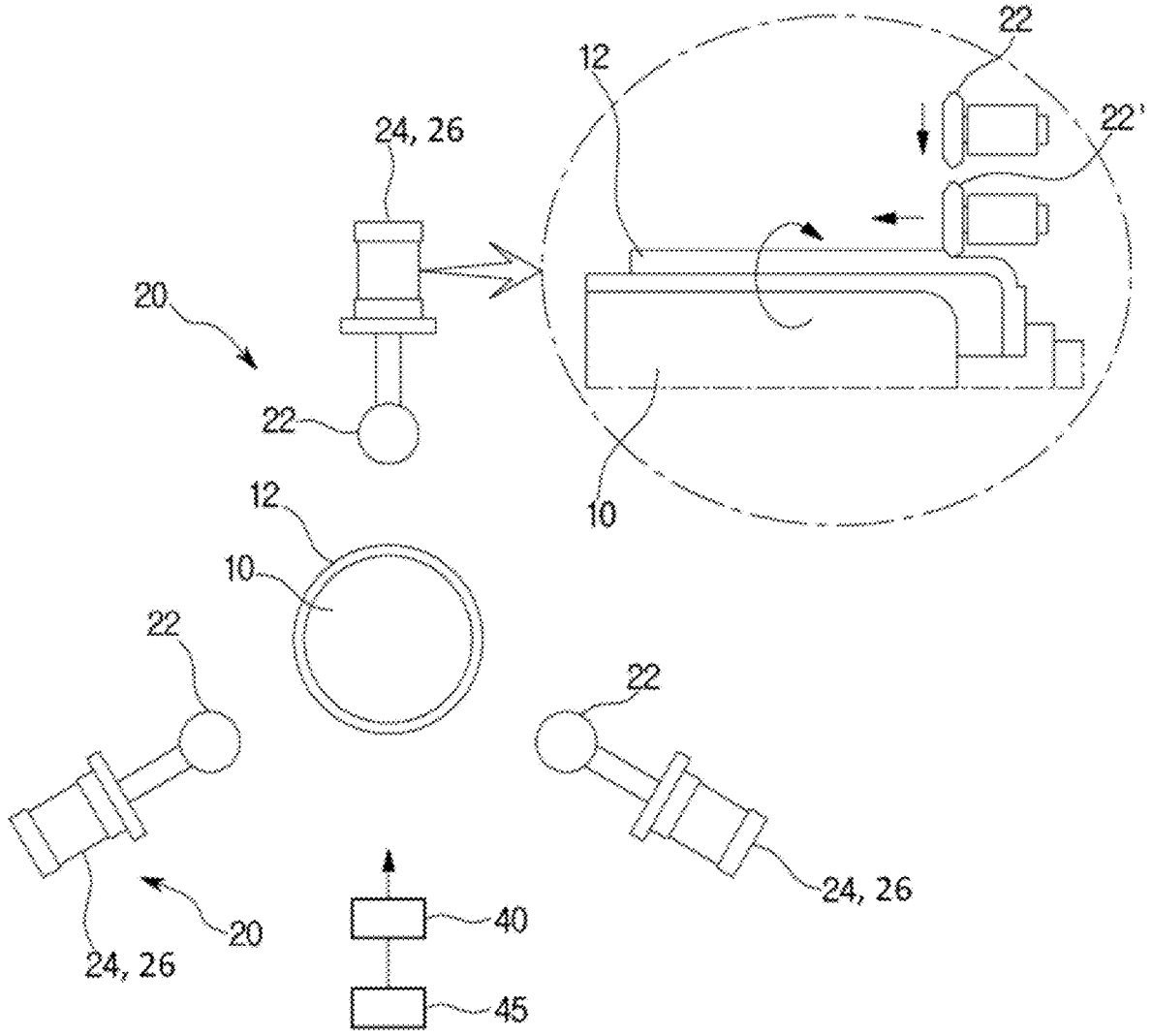
FIG. 1 is a schematic diagram showing an entire configuration of a system according to the present invention.

FIG. 1 shows a state in which the material 12 is loaded on an outer circumferential surface of the mandrel 10 having a cylindrical shape. The material 12 may be detachably clamped at one end of the mandrel 10 so as to integrally interwork with the mandrel 10. The one end of the mandrel 10 may be connected to a rotary actuator 15 capable of adjusting a rotation speed while applying a rotation force.

In addition, according to the present invention, a forming member 20 including a plurality of forming rollers 22 disposed at a periphery of the mandrel 10 may have a structure in which each of the forming roller 22 includes a motion device.

The forming roller 22, the motion device, and the like constituting the forming member 20 are shown in FIG. 1. A plurality of forming rollers 22 may be provided, and each of the forming rollers 22 may be connected to the motion device that will be described below. The forming roller 22 may be passively rotated, or may perform a forced rotation implemented by a separate power. As the forming roller 22 moves in an axial direction of the mandrel 10 while approaching the mandrel 10 in a radial direction of the mandrel as indicated by a reference numeral 22', variations in a thickness and a length of the material 12 may be induced.

According to the detailed configuration of the present invention, the forming member 20 may induce individual transfer and depth motions with motion devices 24 and 26 connected to each of three forming rollers 22.

FIG. 1 shows a state in which each of the three forming rollers 22 disposed in the radial direction of the mandrel 10 is connected to the motion devices 24 and 26 so as to perform a biaxial motion. A first motion device 24 may be configured as a hydraulic cylinder for inducing a radial motion of the forming roller 22, and a second motion device 26 may be configured as a linear actuator for inducing an axial motion of the forming roller 22. The hydraulic cylinder may preferably be, but is not limited to, a servo-controllable hydraulic driving type so as to make contact with the material and apply an accurate and sufficient pressing force. The linear actuator may be selected from: an LM guide; a rack and a pinion; and a lead screw and a nut block. In either case, the motion devices 24 and 26 may perform individual motion control for the three forming rollers 22. According to such a scheme, it may be advantageous to increase a degree of freedom of a shape and reduce a forming load (energy) regardless of physical properties of the material.

Meanwhile, when the three forming rollers 22 are disposed as shown in FIG. 1, a pattern of a motion of the forming roller 22 in a vertical direction may be differentiated from patterns of motions of the forming rollers 22 in an inclined direction. Control patterns of the two forming rollers 22 in the inclined direction may also be differentiated from each other depending on a rotation direction and a rotation speed of the mandrel 10. This may be determined by formation of a DB with information generated and accumulated in a processing step, not by three-dimensional analysis related to flow forming.

Figure 2A:
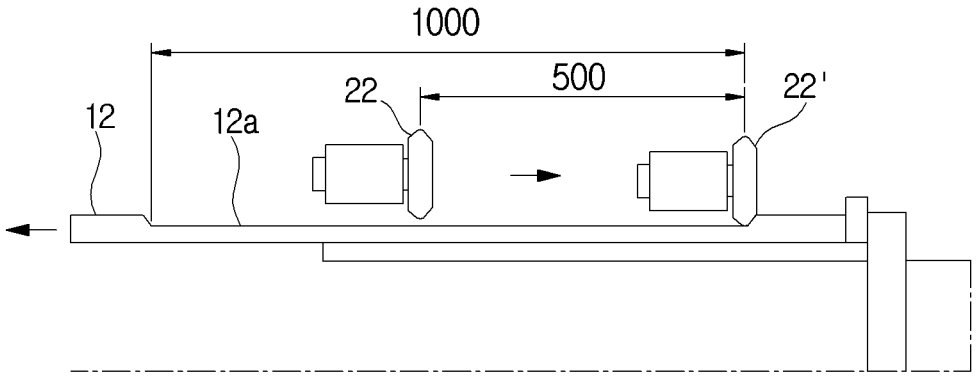
FIGS. 2(*a*)-2(*c*) are schematic diagrams showing a processing principle applied to the system according to the present invention.
Figure 2B:
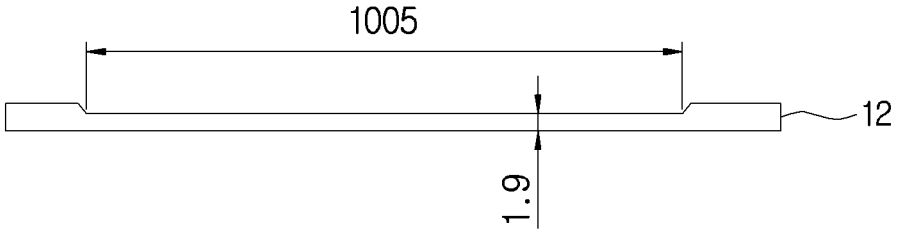
Figure 2C:
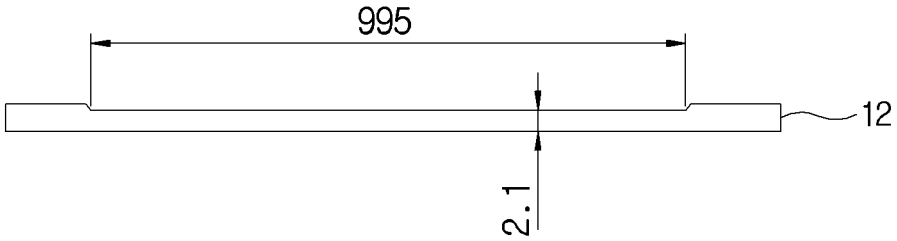

FIG. 2(*a*) shows a state in which the material 12 is formed as a product having a concave part 12*a* formed by reducing a thickness of the material 12 over a predetermined length in an intermediate portion of the material 12. In a case of forward forming, the forming roller 22 may be transferred in an elongation direction of the material so that the concave part 12*a* may be easily formed. However, a length of the mandrel 10 may be increased, so that an overall outward shape may be increased, and workability may deteriorate. Meanwhile, in a case of backward forming in which the forming roller 22 is transferred in a direction opposite to the elongation direction of the material, a short mandrel 10 may be used, so that processing may be facilitated, and thus the backward forming has been universally applied. As illustrated, when the forming roller 22 has to be transferred by 1000 mm in the case of the forward forming, the forming roller 22 may be transferred by 500 mm, which is sufficient, in the case of the backward forming.

However, according to the backward forming, an error may be induced in a prescribed length of 1000 mm due to an error in a prescribed thickness of 2.0 mm as shown in FIGS. 2(*b*) and 2(*c*). As shown in FIG. 2(*b*), when the thickness is 1.9 mm, the length may be increased to 1005 mm, and as shown in FIG. 2(*c*), when the thickness is 2.1 mm, the length may be decreased to 995 mm, so that there is apprehension that the length may deviate from the prescribed length so as to cause defects.

In addition, according to the present invention, a detection member 30 may have a structure for detecting a signal associated with a motion of the forming member 20 corresponding to the material 12.

Figure 3:
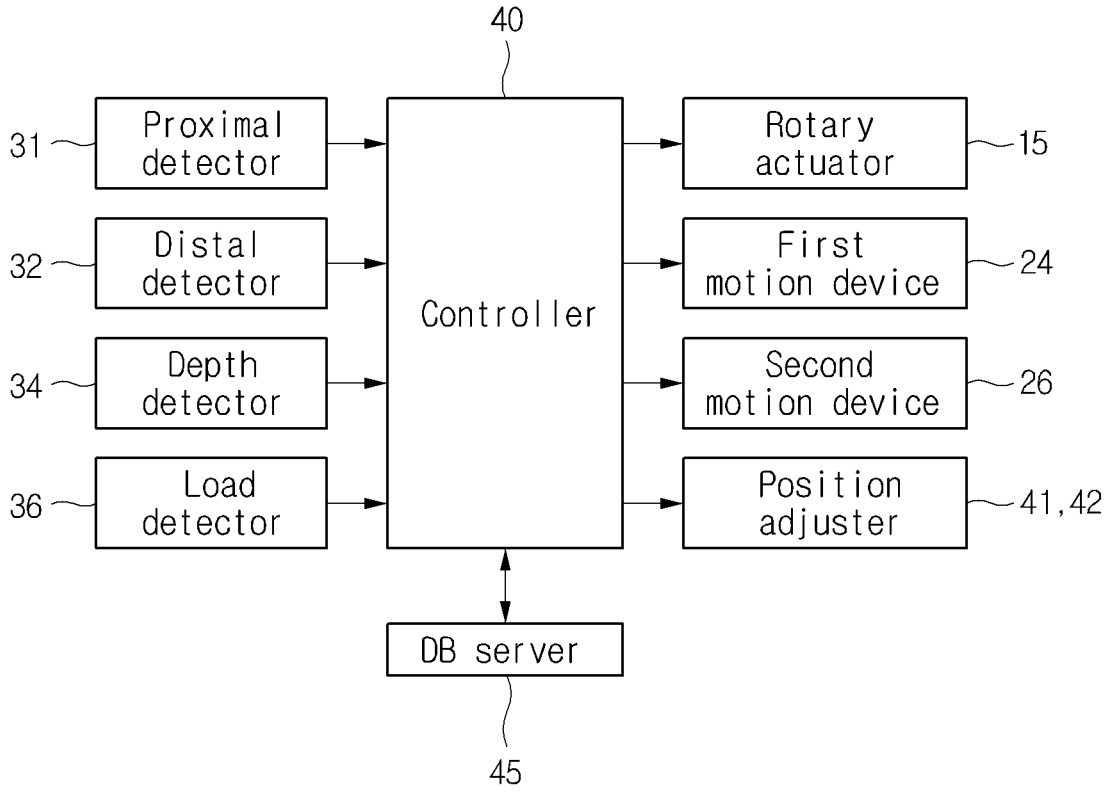
FIG. 3 is a block diagram showing a control circuit of the system according to the present invention.

FIG. 3 shows a state in which the detection member 30 interworks with the forming member 20, a controller 40, and the like. An operation of the detection member 30 at a mass production site may be implemented by interworking with a plurality of route codes based on a computer numerical control (CNC) program. Nonetheless, in the case of the backward forming, it is not easy to adjust thickness-length dimensions during a forming process of a product having the concave part 12*a*, in which a thickness of a portion of the product varies. The detection member 30 may detect a main physical quantity associated with the motion of the forming roller 22 so as to assist simulation performed by the controller 40 that will be described below.

According to the detailed configuration of the present invention, the detection member 30 may include a proximal detector 31 installed on one side of the material 12 in an elongation direction of the material 12, a distal detector 32 installed on an opposite side of a transfer path of the forming roller 22, and a depth detector 34 for detecting a radial depth displacement of the forming roller 22.

FIG. 3 shows the proximal detector 31, the distal detector 32, the depth detector 34, and the like constituting the detection member 30. The proximal detector 31 on the one side and the distal detector 32 on the opposite side may detect an end of the elongated material 12 in a non-contact manner using a photosensor or the like. The proximal detector 31 and the distal detector 32 may be arranged such that the proximal detector 31 is closer to the forming roller 22 than the distal detector 32 on a straight line parallel to the axial direction of the mandrel 10. A separation distance between the proximal detector 31 and the distal detector 32 may correspond to a length dimension of the concave part 12*a* of the product. The depth detector 34 may be selected from a laser sensor, an infrared sensor, an ultrasonic sensor, a linear-scale sensor, and the like, and may detect a displacement of each of the forming rollers 22 in the radial direction of the mandrel 10. In addition, a displacement sensor for detecting an axial transfer distance of the forming roller 22 may be further included.

According to the detailed configuration of the present invention, the detection member 30 may further include a load detector 36 for detecting a load acting on the material 12 through the forming roller 22.

In FIG. 3, the load detector 36 additionally constituting the detection member 30 has been illustrated, but is not limited thereto. The load detector 36 may be installed in the motion devices 24 and 26 of the forming member 20 so as to detect the load (pressure) acting on the material 12 by the forming roller 22. The load detected by the load detector 36 may include a load in the axial direction as well as a load in the radial direction. In addition, a rotation detector for detecting a rotation of the mandrel 10 and the like may be included.

In addition, according to the present invention, the controller 40 has a structure for controlling the forming roller 22 to induce a variation in a depth at at least two set points while transferring the forming roller 22 backward.

Figure 4A:
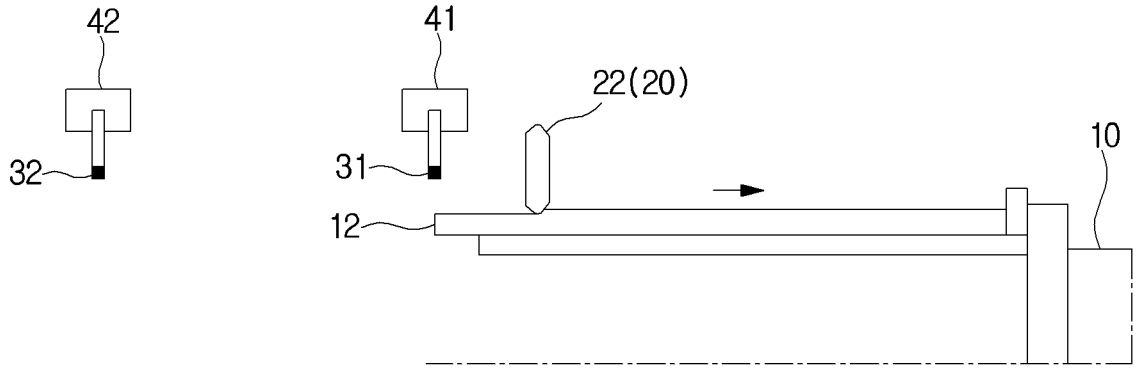
FIGS. 4(*a*)-4(*b*) are schematic diagrams showing a processing state performed by the system according to the present invention.
Figure 4B:
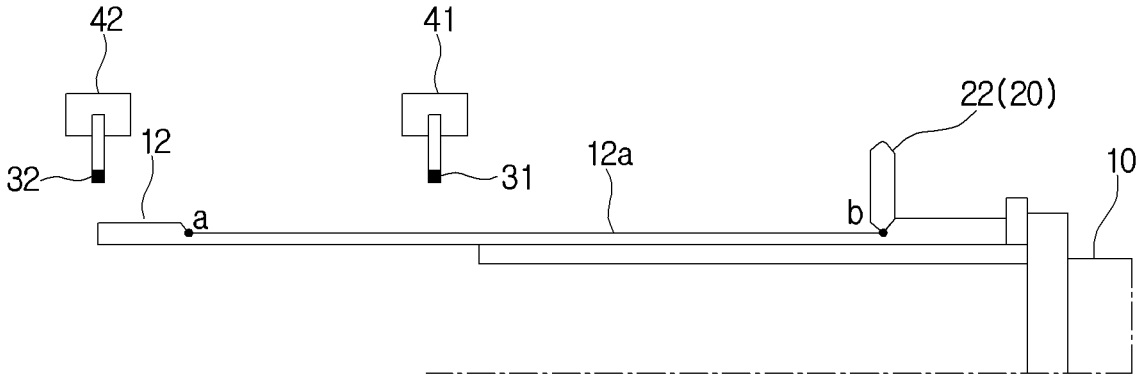

Referring to FIGS. 3 and 4, the controller 40 may include a microprocessor, a memory, and a microcomputer circuit equipped with an input/output interface. The proximal detector 31, the distal detector 32, the depth detector 34, the load detector 36, and the like may be selectively connected to an input interface of the controller 40. The rotary actuator 15, the motion devices 24 and 26, and the like may be connected to an output interface of the controller 40. The controller 40 may be connected to an external DB server 45 for storing design/processing data of all materials 12 put into the mass production site through wired/wireless communication.

In this case, the controller 40 may include points a and b of FIG. 4(*b*) corresponding to the concave part 12*a* of FIG. 2(*a*) described above as coordinates inducing a depth variation of the forming roller 22.

Meanwhile, the controller 40 may be mounted on each of position adjusters 41 and 42 so as to induce variations in positions of the proximal detector 31 and the distal detector 32. The position adjusters 41 and 42 may be configured similarly to the linear actuator of the second motion device 26. The positions of the proximal detector 31 and the distal detector 32 may vary according to the length dimension of the concave part 12*a* of the product.

According to the detailed configuration of the present invention, the controller 40 may interwork with a computer numerical control (CNC) program to sequentially execute a biaxial motion of the forming roller 22, and stop processing according to a dimension required for a concave part 12*a* of the material 12.

Referring to FIGS. 3 and 4, the controller 40 may store a CNC processing program, which is converted to reflect movement coordinates of the forming roller 22 by using a CAD/CAM program, in the memory and execute the CNC processing program. As shown in FIG. 4(*a*), as the backward forming is started by the forming roller 22, when the material 12 is elongated due to a decrease in the thickness of the material 12 so that the end of the material 12 reaches the proximal detector 31, the forming roller 22 may descend to a set depth to start forming the concave part 12*a*. Thereafter, as shown in FIG. 4(*b*), when the end of the material 12 reaches the distal detector 32, the forming roller 22 may immediately ascend, a finishing process may be performed in a set path, and the process may be terminated. After the concave part 12*a* of the material 12 is normally formed, one or both ends of the material 12 may be cut so as to be finished as a product.

Since such processing information of the mass production site is accumulated in the DB server 45 through the controller 40, an effort and a time required for process management may be saved to reduce defects and improve productivity even in small-quantity batch production.

The present invention is not limited to the described embodiments, and it will be appreciated by a person having ordinary skill in the art that various changes and modifications can be made without departing from the idea and scope of the present invention. Therefore, such modifications or changes fall within the scope of the claims of the present invention.

What is claimed is:

1. An automatic control system for a backward flow forming process, the automatic control system comprising:

a mandrel or concentrically supporting a material;

a forming member including three forming rollers disposed at a periphery of the mandrel, each of the three forming rollers including a motion device, the motion device including a first motion device and a second motion device;

a detection member for detecting a signal associated with a motion of the forming member corresponding to the material; and a controller for controlling the three forming rollers to set a variation in a depth at at least two set points while transferring the three forming rollers backward, wherein each of the first motion devices is configured to set an individual transfer motion of each forming roller, and each of the second motion devices is configured to set an individual depth motion of each forming roller, wherein the detection member includes a proximal detector installed on one side in an elongation direction of the material, a distal detector installed on another side opposite to a transfer path of each of the three forming rollers, and a depth detector for detecting a radial depth displacement of each of the three forming rollers, and wherein the controller is configured to interwork with a computer numerical control (CNC) program to sequentially execute a biaxial motion of the three forming rollers, and stop processing of the material according to a dimension required for a concave part of the material.

2. The automatic control system of claim 1, wherein the detection member further includes a load detector for detecting a load acting on the material by the three forming rollers.

* * * * *